US006614011B2

(12) United States Patent
Omori et al.

(10) Patent No.: US 6,614,011 B2
(45) Date of Patent: Sep. 2, 2003

(54) MICROWAVE OVEN INCLUDING ANTENNA FOR PROPERLY PROPAGATING MICROWAVES OSCILLATED BY MAGNETRON

(75) Inventors: Yoshiharu Omori, Otsu (JP); Ryota Isshiki, Otsu (JP); Kuniyasu Kubo, Otsu (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 95 days.

(21) Appl. No.: 09/726,382

(22) Filed: Dec. 1, 2000

(65) Prior Publication Data

US 2001/0002670 A1 Jun. 7, 2001

(30) Foreign Application Priority Data

Dec. 7, 1999 (JP) ..... 11-347260

(51) Int. Cl.[7] ..... H05B 6/72
(52) U.S. Cl. ..... 219/748; 219/749; 219/751
(58) Field of Search ..... 219/746, 748, 219/749, 751

(56) References Cited

U.S. PATENT DOCUMENTS

| | | | | |
|---|---|---|---|---|
| 3,872,276 A | * | 3/1975 | Corcoran et al. | 219/751 |
| 4,092,513 A | | 5/1978 | Rasmussen | |
| 4,176,266 A | * | 11/1979 | Kaneko et al. | 219/749 |
| 4,324,967 A | * | 4/1982 | Ikeda et al. | 219/749 |
| 4,350,859 A | * | 9/1982 | Dudley et al. | 219/749 |
| 4,421,968 A | | 12/1983 | Osepchuk | |
| 4,424,430 A | | 1/1984 | Almgren et al. | |
| 4,430,538 A | * | 2/1984 | Suzuki et al. | 219/749 |
| 4,496,814 A | | 1/1985 | Fitzmayer | |
| 4,556,772 A | | 12/1985 | McCammon et al. | |
| 4,641,006 A | * | 2/1987 | Ross et al. | 219/749 |
| 4,833,286 A | | 5/1989 | Ohnishi | |

FOREIGN PATENT DOCUMENTS

| | | | | |
|---|---|---|---|---|
| JP | 52-41939 | * | 3/1977 | 219/749 |
| JP | 7073967 | | 3/1995 | |
| JP | 8-8059 | * | 1/1996 | |
| JP | 8-148272 | * | 6/1996 | |

* cited by examiner

*Primary Examiner*—Philip H. Leung
(74) *Attorney, Agent, or Firm*—Armstrong, Westerman & Hattori, LLP

(57) ABSTRACT

An opening is formed in a right side of a heating chamber. The opening is covered by a protection cover. A waveguide is connected to the opening. A magnetron is connected to the waveguide. The magnetron has a magnetron antenna. An emission antenna is arranged around the magnetron antenna. A rotating plate is mounted to the protection cover. A plurality of diffusion antennas are mounted to the rotating plate. The diffusion antennas are arranged from the waveguide to the heating chamber.

6 Claims, 13 Drawing Sheets

MICROWAVE OVEN INCLUDING ANTENNA FOR PROPERLY PROPAGATING MICROWAVES OSCILLATED BY MAGNETRON

BACKGROUND OF THE INVENTION

1. Field of the Invention

The present invention relates to microwave ovens generating microwaves and, more particularly, to a microwave oven including an antenna for properly propagating microwaves oscillated by a magnetron, as separate from a magnetron antenna.

2. Description of the Background Art

Some of conventional microwave ovens include an emission antenna in a waveguide. The emission antenna is connected, in terms of microwaves, to a magnetron antenna protruding from a magnetron. The provision of such an emission antenna increases power supply efficiency of microwaves to a heating chamber in the microwave oven.

Further, some of the conventional microwave ovens include an antenna for diffusion (hereinafter referred to as a diffusion antenna) on the side of a heating chamber, in addition to the emission antenna. The diffusion antenna may include a plurality of metal pieces radially arranged about a magnetron antenna or rotatably arranged. The diffusion antenna is provided for efficiently and uniformly supplying microwaves to the heating chamber.

In the conventional microwave oven, however, the impedances of the magnetron and the heating chamber cannot be sufficiently matched by merely providing the emission antenna in the waveguide or the diffusion antenna on the side of the heating chamber. If the impedances of the magnetron and the heating chamber are not sufficiently matched, most of the microwaves oscillated by the magnetron would be reflected back to the magnetron rather than be supplied to the heating chamber. Thus, the conventional microwave oven is desired to efficiently heat food by supplying as many microwaves oscillated by the magnetron as possible to the heating chamber.

Further, conventionally, it is difficult to uniformly supply microwaves to the entire heating chamber when microwaves are supplied to the heating chamber from the magnetron. Namely, the microwaves are often supplied unevenly to the heating chamber. As a result, food cannot be efficiently heated.

Moreover, a plurality of antennas may cause electric discharge thereamong. In such a case, similarly, food cannot be heated efficiently because the microwaves are not properly supplied to the heating chamber.

If a metal piece which is rotated by air force is provided as an antenna on the side of the heating chamber, a hole for guiding the air for rotation of the metal piece is formed in the heating chamber or waveguide. In this case, a wire or the like may be inadvertently inserted into the hole. Thus, such a hole must be made as small as possible. However, if the hole is too small, the metal piece cannot be sufficiently rotated. In such a case, microwaves supplied from the magnetron cannot be sufficiently agitated. As a result, the problem associated with unevenness of the microwaves supplied to the heating chamber is not eliminated and food cannot be efficiently heated.

SUMMARY OF THE INVENTION

The present invention is made to solve the aforementioned problem. An object of the present invention is to provide a microwave oven capable of efficiently heating food.

Another object of the present invention is to reliably provide for matching the impedances of the magnetron and the heating chamber.

Still another object of the present invention is to supply microwaves uniformly to the heating chamber.

Another object of the present invention is to avoid electric discharge among antennas provided in addition to a magnetron antenna.

A microwave oven according to one aspect of the present invention includes: a heating chamber containing food; a magnetron for heating the food in the heating chamber; a waveguide connected to the heating chamber and the magnetron for guiding microwaves oscillated by the magnetron to the heating chamber; and a diffusion antenna for diffusing microwaves oscillated by the magnetron. The microwave oven of the present invention is characterized in that the diffusion antenna extends from inside the waveguide to the heating chamber.

According to the present invention, an antenna extends from inside the waveguide to the heating chamber.

This enables the impedances of the magnetron and the heating chamber to be more reliably matched. Thus, the microwave oven can efficiently heat food.

Preferably, the microwave oven of the present invention further includes an antenna rotating portion for rotating the diffusion antenna.

Thus, the microwaves oscillated by the magnetron can be uniformly supplied to the heating chamber. This prevents heat unevenness of the food in the heating chamber.

Preferably, in the microwave oven of the present invention, the antenna rotating portion rotates the diffusion antenna by air force. The waveguide has a hole for permitting the air enter the waveguide from the antenna rotating portion and further includes an air guide member for guiding the air from a fan to the waveguide. The waveguide member has a wall opposite the hole of the waveguide.

This enables the diffusion antenna to be efficiently rotated and a bar-like foreign matter such as a wire would not be inserted to the hole of the microwave oven.

Preferably, in the microwave oven of the present invention, an antenna supporting plate supported by the diffusion antenna and having a main surface is further provided. As the antenna rotating portion rotates the antenna supporting plate in a plane including a main surface of the antenna supporting plate, the diffusion antenna is rotated. The diffusion antenna has a surface which is parallel to the main surface of the antenna supporting plate.

According to the present invention, the diffusion antenna can be more stably rotated.

Preferably, the microwave oven of the present invention further includes an antenna supporting plate capable of supporting a plurality of diffusion antennas. The antenna supporting plate has notches in a region between adjacent diffusion antennas on the antenna supporting plate.

According to the present invention, the adjacent diffusion antennas can be electrically insulated, so that electric discharge therebetween can be avoided.

Preferably, the microwave oven of the present invention is provided with a magnetron antenna used by the magnetron to radiate microwaves. The diffusion antennas are arranged at prescribed intervals in a circumferential direction of the magnetron antenna.

As such, the diffusion antennas can reliably diffuse the emitted microwaves through the magnetron antenna. Thus, heat unevenness of the food in the heating chamber can be reliably prevented.

Preferably, in the microwave oven of the present invention, the diffusion antenna has a plurality of surfaces, at least one of which is in a plane not passing the center of the magnetron antenna.

Thus, the microwaves supplied through the diffusion antenna would not concentrate near the center of the magnetron antenna. Accordingly, the microwaves oscillated by the magnetron can be efficiently supplied to the heating chamber.

Preferably, in the microwave oven of the present invention, the diffusion antenna has an end which is parallel to an inner wall of the waveguide.

Thus, a propagation path for microwaves is formed between the diffusion antenna and the inner wall of the waveguide. Accordingly, the microwaves can be efficiently supplied to the heating chamber through the diffusion antenna.

A microwave oven according to another aspect of the present invention includes: a heating chamber containing food; a magnetron for heating the food in the heating chamber; a magnetron antenna for emitting microwaves; and an emission antenna provided at the periphery of the magnetron antenna. The microwave oven is characterized in that the emission antenna is asymmetric with respect to the magnetron antenna in a plane orthogonal to the propagation direction of the microwaves oscillated by the magnetron.

According to the present invention, a distribution of the microwaves supplied to the heating chamber can be varied by changing the shape of the emission antenna.

Thus, the distribution of the microwaves supplied to the heating chamber can be varied according to the mounting position of the magnetron to the heating chamber in the microwave oven, so that the food can be efficiently heated.

Preferably, the microwave oven of the present invention further includes a waveguide connected to the heating chamber and the magnetron for guiding the microwaves oscillated by the magnetron to the heating chamber. A minimum distance in space between the magnetron antenna and the waveguide, excluding objects for reflecting the microwaves, is at least 7 mm.

Thus, electric discharge can be avoided between the magnetron antenna and the waveguide. Accordingly, secure operation of the microwave oven is ensured.

Preferably, the microwave oven of the present invention further includes a diffusion antenna provided in the waveguide. The emission antenna and a metal piece are arranged to overlap with each other in a propagation direction of the microwaves oscillated by the magnetron.

As a result, the microwaves are more intensely coupled in the propagation path within the waveguide. Accordingly, in the microwave oven, the microwaves can be efficiently supplied to the heating chamber.

Preferably, in the microwave oven of the present invention, at least one of the emission antenna and the diffusion antenna does not have a surface perpendicular to the inner wall of the waveguide.

Thus, electric discharge from the emission antenna or the diffusion antenna to the waveguide due to concentration of electric field at the wall of the waveguide can be avoided.

Preferably, in the microwave oven of the present invention, the magnetron has a magnetron antenna for emitting the microwaves. The diffusion antenna further includes a plurality of metal pieces radially arranged about the magnetron antenna near portions where the emission antenna is opposite another diffusion antenna through the magnetron antenna.

Thus, current can be supplied to another diffusion antenna through the metal piece at the portion near the magnetron antenna of each diffusion antenna. Accordingly, concentration of electric field at the portion near the magnetron antenna of each diffusion antenna can be avoided, so that the microwaves can be efficiently supplied to the heating chamber through the diffusion antenna.

A microwave oven according to still another aspect of the present invention includes: a heating chamber containing food; a magnetron for heating the food in the heating chamber; and a diffusion antenna for diffusing microwaves oscillated by the magnetron. The microwave oven is characterized in that the magnetron has a magnetron antenna for emitting the microwaves, and the diffusion antenna includes a plurality of metal pieces radially arranged about the magnetron antenna and arranged near the portions where the diffusion antenna is opposite another diffusion antenna through the magnetron antenna.

According to the present invention, current can be supplied to another diffusion antenna through the metal piece at the portion near the magnetron antenna of each diffusion antenna.

Thus, concentration of electric field to the portion near the magnetron antenna of each diffusion antenna can be avoided, so that the microwaves can be efficiently supplied to the heating chamber through the diffusion antenna.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Now, embodiments of the microwave oven of the present invention will be described with reference to the drawings.

First Embodiment

Figure 1:
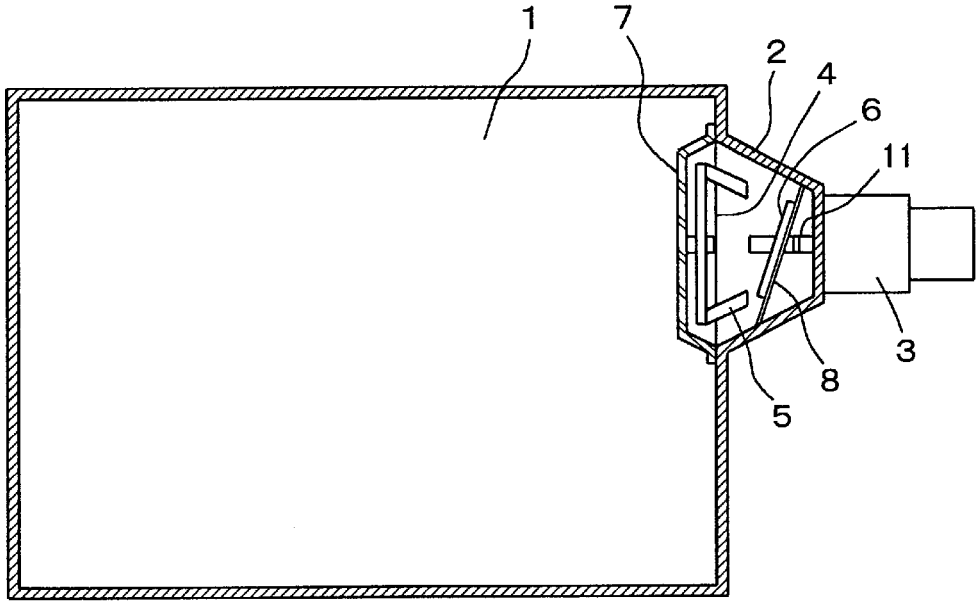
FIG. 1 is a cross sectional view of a microwave oven of a first embodiment of the present invention.
Figure 2:
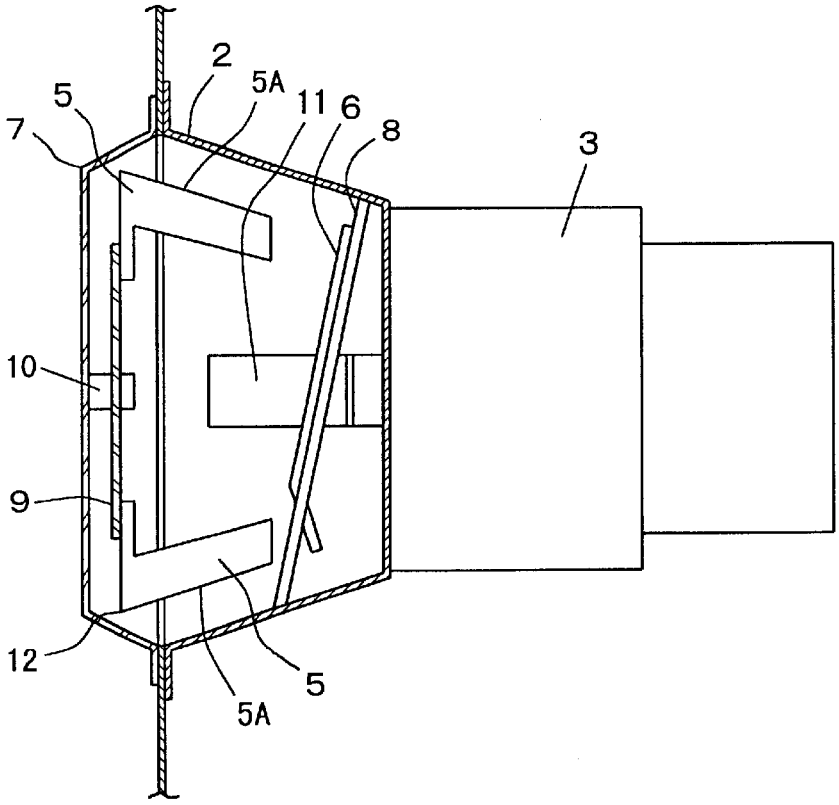
FIG. 2 is a cross sectional view of the microwave oven of FIG. 1, showing in enlargement a waveguide portion.
Figure 3:
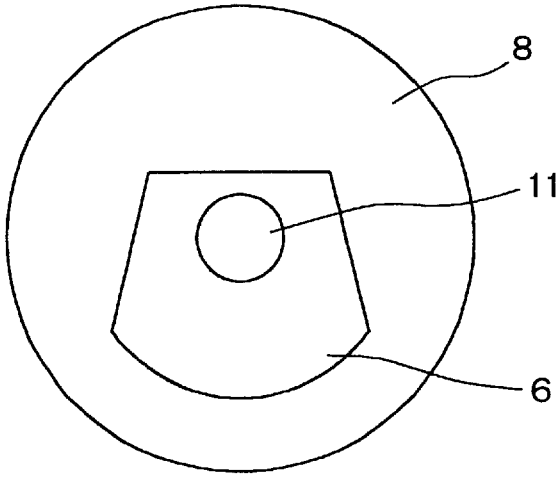
FIG. 3 is a front view of a fixing plate, an emission antenna and a magnetron antenna shown in FIG. 2.

Referring to FIGS. 1 to 3, a microwave oven according to the first embodiment of the present invention will be described.

Referring to FIG. 1, an opening 4 is formed in a right wall of a heating chamber 1. One end of a waveguide 2 is provided outside heating chamber 1 at opening 4, and the other end of waveguide 2 is mounted to a magnetron 3. Thus, microwaves oscillated by magnetron 3 are supplied to heating chamber 1 through waveguide 2 and opening 4.

An emission antenna 6 is arranged in waveguide 2.

A protection cover 7 is provided in heating chamber 1, inside opening 4. A plurality of diffusion antennas 5 are rotatably attached to protection cover 7. In the present embodiment, a diffusion antenna for diffusing the microwaves oscillated by the magnetron is formed by diffusion antenna 5. Note that although the diffusion antenna is rotatable in the present embodiment, the diffusion antenna may be fixed.

Referring to FIG. 2, diffusion antenna 5 is attached to protection cover 7 through a rotating plate 9. Rotating plate 9 is formed of a dielectric material such as a mica plate. A rotating shaft 10 is mounted to protection cover 7. Rotating plate 9 is rotatably attached to protection cover 7 by inserting rotating shaft 10 into a hole at the center of rotating plate 9. In the present embodiment, an antenna supporting plate for supporting the diffusion antenna is formed by rotating plate 9.

Magnetron 3 has a magnetron antenna 11. Magnetron antenna 11 protrudes from magnetron 3 toward heating chamber 1. A fixing plate 8 is arranged around magnetron antenna 11. Fixing plate 8 is formed of a dielectric material such as a mica plate. An emission antenna 6 is mounted onto fixing plate 8. Emission antenna 6 is arranged around magnetron antenna 11 while being coupled to magnetron antenna 11 in terms of microwaves. If the shape of emission antenna 6 is changed, directivity of power supplied from magnetron 3 to heating chamber 1 is varied. For example, if the shape of emission antenna 6 is asymmetric with respect to magnetron antenna 11, heat unevenness in heat chamber can be prevented. FIG. 3 is a front view showing fixing plate 8, emission antenna 6, and magnetron antenna 11. Note that FIG. 3 corresponds to a view showing the elements of FIG. 2 when viewed from the left side.

As shown in FIG. 3, emission antenna 6 has a greater area below magnetron antenna 11 than above magnetron antenna 11. Note that the shape of emission antenna 6 should be changed according to a positional relationship between magnetron 3 and heating chamber. Namely, in the present embodiment, because magnetron 3 is arranged above the middle of heating portion 1, the shape of emission antenna 6 is determined such that the microwaves are supplied to the lower side. Having the shape as shown in FIG. 3, emission antenna 6 is asymmetric with respect to magnetron antenna 11 in a plane orthogonal to the propagation direction of the microwaves oscillated by magnetron 3.

Diffusion antenna 5 has a portion 5A that is substantially parallel to the wall surface of waveguide 2. Portion 5A that is parallel to the wall of waveguide 2 of diffusion antenna 5 extends from inside waveguide 2 to heating chamber 1. Thus, the propagation path of microwaves is formed between diffusion antenna 5 and the wall of waveguide 2, so that the microwaves can be efficiently supplied to heating chamber 1 through diffusion antenna 5.

A periphery of diffusion antenna 5 is denoted by a reference numeral 12. Periphery 12 is a farthest portion from rotating shaft 10 in diffusion antenna 5. An outer edge of rotating plate 9 is closer to rotating shaft 10 than periphery 12 of diffusion antenna 5. Accordingly, even if rotating plate 9 is leaned toward the main surface of protection cover 7, the outer edge of rotating plate 9 would not contact with protection cover 7.

Second Embodiment

Figure 4:
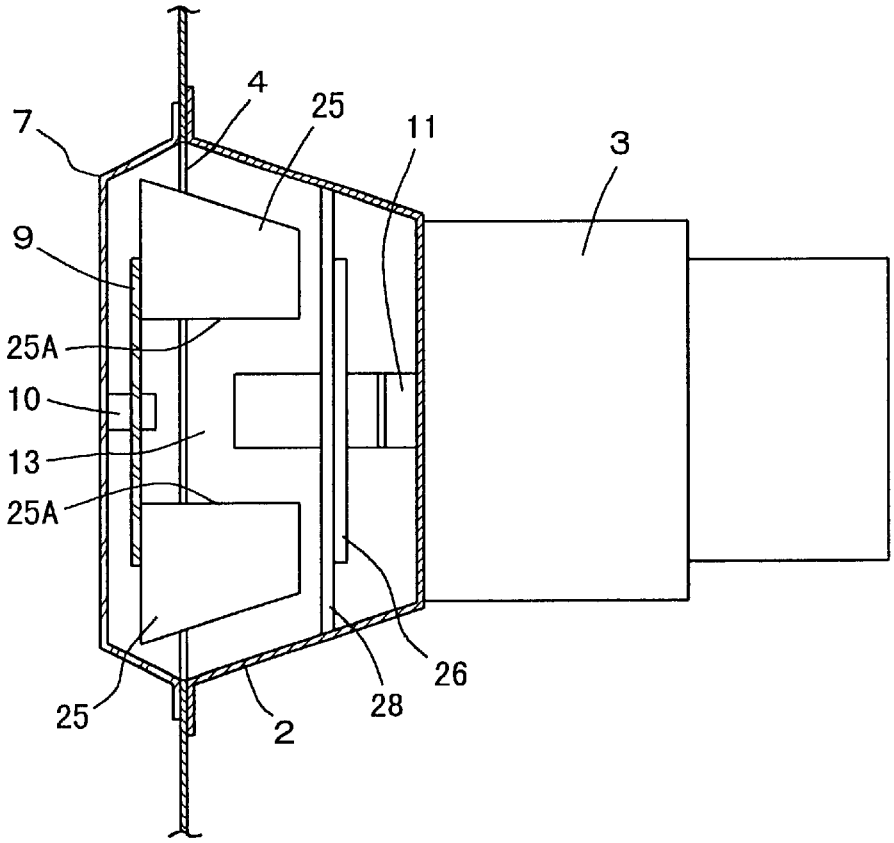
FIG. 4 is a cross sectional view showing a waveguide portion of a microwave oven according to a second embodiment of the present invention.
Figure 5:
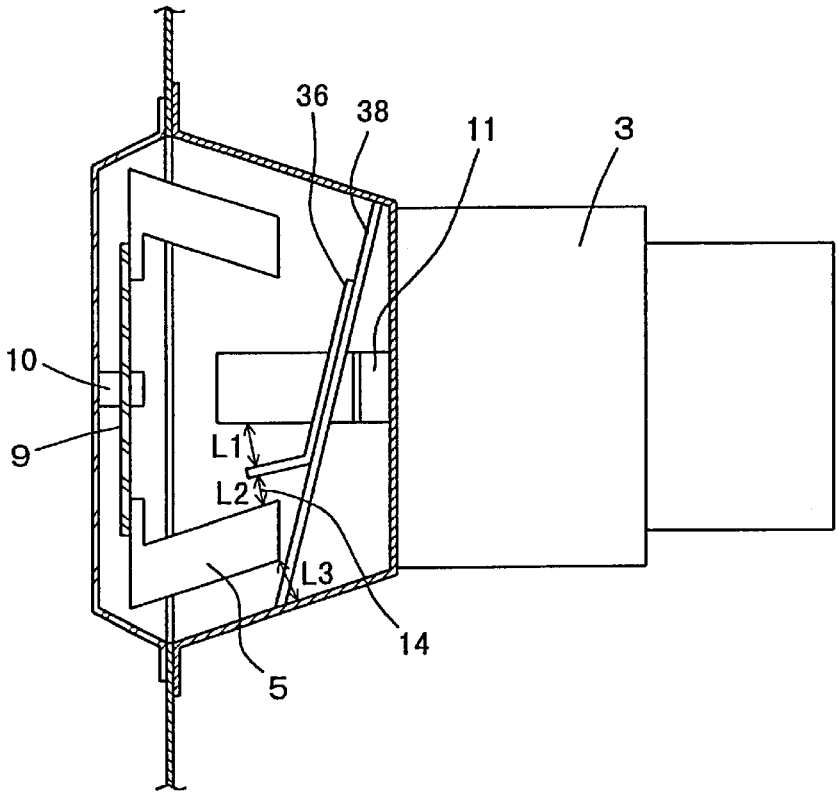
FIG. 5 is a cross sectional view showing a waveguide portion of a microwave oven according to a third embodiment of the present invention.

Referring to FIG. 4, a microwave oven according to the second embodiment of the present invention will be described. It is noted that the components similar to those of the microwave oven of the first embodiment are denoted by the same reference numerals in FIG. 4, and therefore detailed description thereof will not be repeated.

In the present embodiment, one end of a waveguide 2 is connected to an opening 4 of a heating chamber 1, whereas the other end of waveguide 2 is connected to a magnetron 3. A protection cover 7 is provided at opening 4, inside heating chamber 1. A rotating shaft 10 mounted to protection cover 7, onto which rotating plate 9 is fitted.

A plurality of diffusion antennas 25 are mounted on rotating plate 9. Diffusion antenna 25 has a surface 25A which is parallel to an outer surface of a magnetron antenna 11. Thus, the microwaves are more intensely coupled in the propagation path between diffusion antenna 25 and magnetron antenna 11. Accordingly, power can be efficiently supplied to a center 13 of the opening of waveguide 2 on the side of heating chamber 1 from magnetron antenna 11.

A fixing plate 28 of a dielectric material is provided around magnetron antenna 11, and an emission antenna 26 is provided on fixing plate 28.

Diffusion antenna 25 rotates when air is introduced to waveguide 2 along the main surface of rotating plate 9, i.e., in a direction perpendicular to the sheet of paper of FIG. 4. Note that fixing plate 28 is provided in parallel with rotating plate 9 in the present embodiment. Thus, fixing plate 28 serves as an air path for rotating diffusion antenna 25.

Third Embodiment

Referring to FIGS. 5 to 13, a microwave oven according to the third embodiment of the present invention will be described. Note that, in FIG. 5, the components similar to those of the microwave oven of the first embodiment are denoted by the same reference numerals, and therefore detailed description thereof will not be repeated.

A fixing plate 38 of a dielectric material is provided around a magnetron antenna 11, and an emission antenna 36 is mounted on fixing plate 38. Emission antenna 36 and diffusion antenna 5 overlap with each other in the propagation direction of microwaves. If a space between the overlapping portions of emission antenna 36 and diffusion antenna 5 in the propagation direction of the microwaves is defined as an overlapping portion 14, the microwaves are more intensely coupled in the propagation path at overlapping portion 14. Thus, in the present embodiment, the microwaves can be efficiently supplied to a heating chamber 1.

In the present embodiment, a total spatial insulation distance between magnetron antenna 11 and a waveguide 2 is at least 7 mm. The total spatial insulation distance refers to a sum of minimum distances between elements (a material such as metal that reflects the microwaves) which affect propagation of the microwaves in the space between magnetron antenna 11 and waveguide 2, i.e., a sum of minimum distances of the spaces excluding these elements. More specifically, the sum of the distances is indicated as (L1+L2+L3) in FIG. 5. Note that, in FIG. 5, L1 is the minimum distance between magnetron antenna 11 and emission antenna 36. L2 is the minimum distance between emission antenna 36 and diffusion antenna 5. L3 is the minimum distance between diffusion antenna 5 and waveguide 2. In this case, because fixing plate 38 is formed of a dielectric material, it does not affect the propagation of microwaves. In the present embodiment, the spatial insulation distance (L1+L2+L3) is at least 7 mm, so that electric discharge at the portion between magnetron antenna 11 and waveguide 2 is prevented. Diffusion antenna 5 refers to a diffusion antenna provided between the magnetron antenna and the waveguide.

Figure 6:
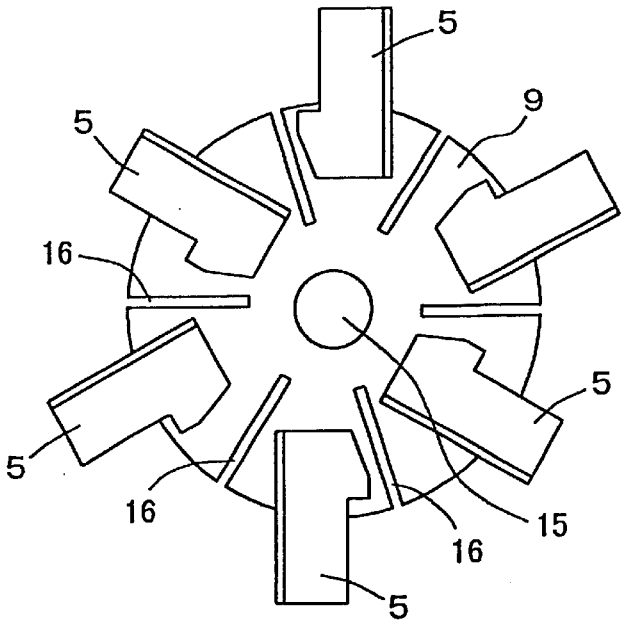
FIG. 6 is a front view showing a rotating plate and diffusion antennas of FIG. 5.

Referring to FIG. 6, a hole 15 formed substantially at the center of rotating plate 9 receives a rotating shaft 10. Note that magnetron antenna 11 extends substantially toward the center of rotating plate 9 (see FIG. 5). Diffusion antennas 5 are arranged not to cover the entire circumference of hole 15, i.e., arranged such that there is a portion not covered by diffusion antennas 5 at the periphery of hole 15. This means that diffusion antennas 5 are arranged not to cover the entire circumference of magnetron antenna 11 in a plane perpendicular to the propagation direction of microwaves, i.e., arranged at prescribed intervals in a circumferential direction outside magnetron antenna 11. Such an arrangement of diffusion antennas 5 allows the microwaves supplied to heating chamber 1 through diffusion antennas 5 to be properly directed to the central portion of opening 4 and to the peripheral portion corresponding to periphery 5A (FIG. 2). Thus, heat unevenness in heating chamber 1 can be reliably prevented.

Although a plurality of diffusion antennas 5 are mounted to rotating plate 9, the distances between these diffusion antennas 5 to hole 15 differ. Namely, the distances from rotating shaft 10 to diffusion antennas 5 differ. Thus, each diffusion antenna 5 has its own manner of supplying power to heating chamber 1, so that the microwaves can be supplied to heating chamber 1 in a number of patterns. In this way, heat unevenness in heating chamber 1 can be avoided.

Rotating plate 9 has a plurality of notches 16. Notches 16 electrically insulate a region of each diffusion antenna 5 on rotating plate 9 from an adjacent diffusion antenna 5. Thus, diffusion antenna 5 has a spatial insulation distance with respect to adjacent diffusion antenna 5. Namely, electric discharge between adjacent diffusion antennas 5 on rotating plate 9 can be avoided.

Figure 7:
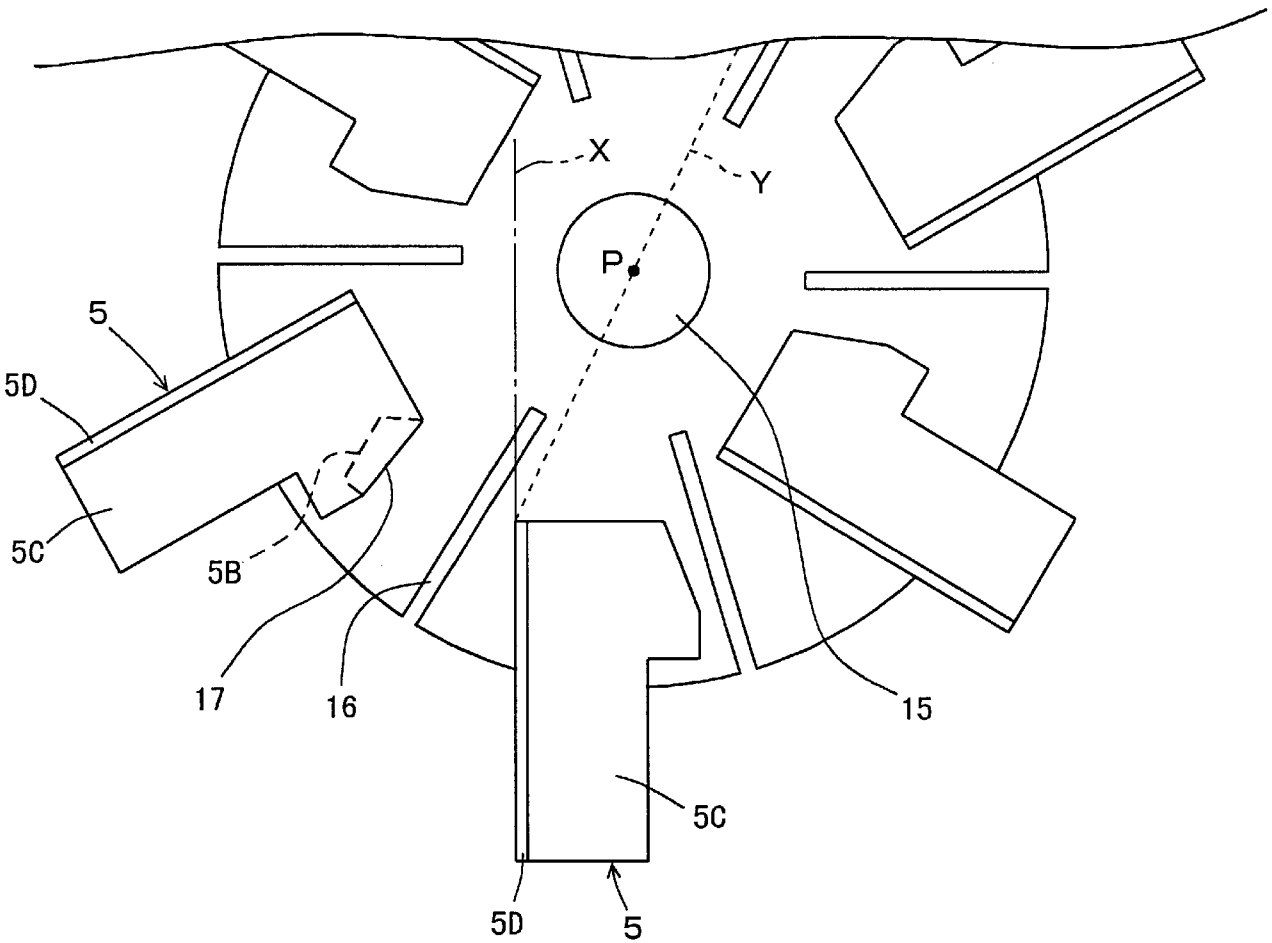
FIG. 7 is a diagram partially showing in enlargement the rotating plate of FIG. 6.
Figure 8:
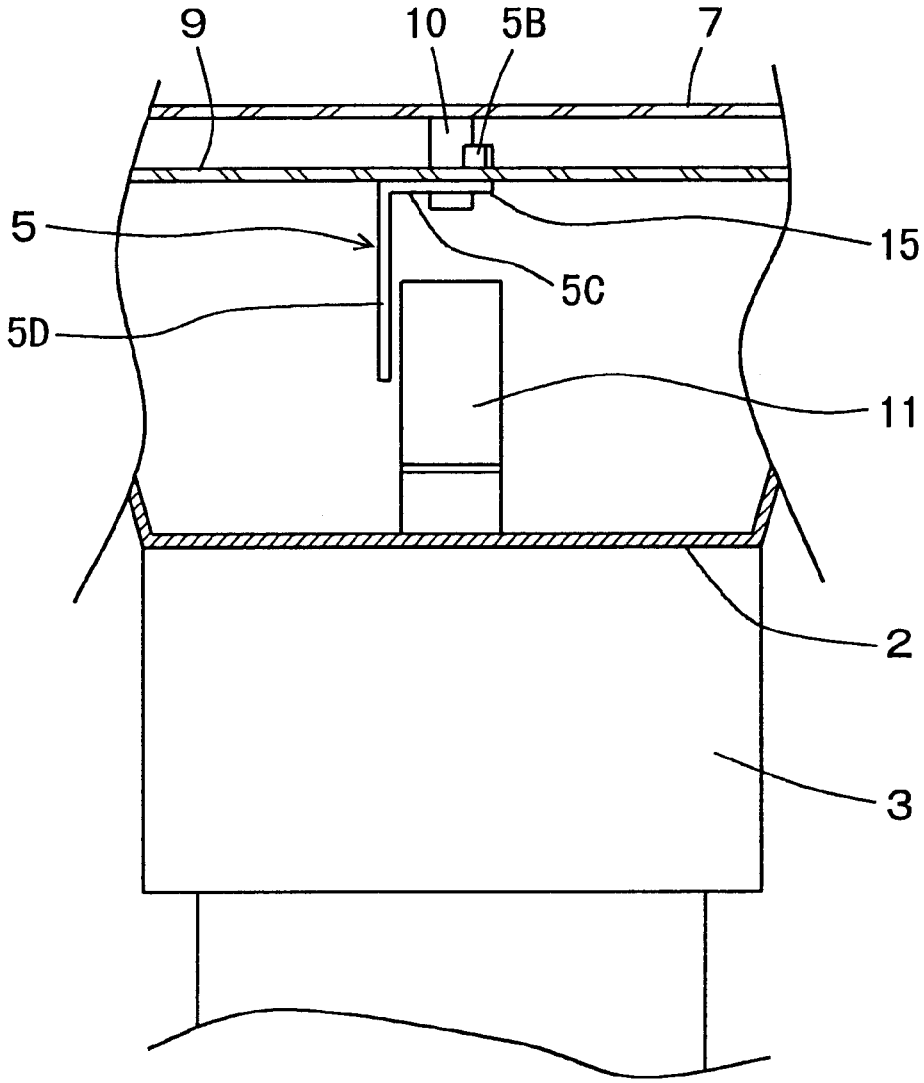
FIG. 8 is a diagram used for explaining a positional relationship between the diffusion antenna and the magnetron antenna of FIG. 5.

Now, the embodiment will be described with reference to FIGS. 7 and 8. Note that emission antenna 36, fixing plate 38 and the like are not shown in FIG. 8.

Diffusion antenna 5 is mounted to rotating plate 9 at its folded portion 17. Note that diffusion antenna 5 generally has a back portion 5B, a bottom plate portion 5C, and a vertical portion 5D. Bottom plate portion 5C and vertical portion 5D are on the front side of rotating plate 9, whereas back portion 5B is on the backside of rotating plate 9. Diffusion antenna 5 is mounted to rotating plate 9 at its folded portion 17, so that a protrusion of diffusion antenna 5 would not be opposite that of another diffusion antenna 5 in a plane of rotation plate 9 where the microwaves propagate. Such a structure can prevent concentration of electric field at the portion where the protrusions of diffusion antennas 5 are opposite, whereby electric discharge between diffusion antennas 5 can be avoided. Further, diffusion antenna 5 is mounted to pass through rotating plate 9 such that folded portion 17 is positioned on the surface of rotating plate 9. Thus, the positioning of diffusion antenna 5 on rotating plate 9 can be facilitated.

A direction (chain-dotted line X of FIG. 7) of a surface of vertical portion 5D of diffusion antenna 5 differs from that of line (dotted line Y of FIG. 7) radially extending from a center P of rotating plate 9. More specifically, vertical portion 5D of diffusion antenna 5 is in the plane not passing center P of magnetron antenna 11. Such a structure prevents concentration of electric field near the center of rotating plate 9 when the microwaves are guided onto rotating plate 9 through magnetron antenna 11. Thus, electric discharge between diffusion antennas 5 can be avoided. Diffusion antenna 5 is formed not to have a surface perpendicular to waveguide 2. Thus, electric discharge from diffusion antenna 5 to waveguide 2 due to concentration of electric field at the wall surface of waveguide 2 can be avoided. Similarly, emission antenna 6 is formed not to have a surface perpendicular to waveguide 2 for the same reason.

Diffusion antenna 5 is arranged to provide the longest distance between magnetron antenna 11 and diffusion antenna 5 when rotating plate 9 stops its rotation. Thus, electric discharge between diffusion antennas 5 at the next start of oscillation of magnetron 3 can be reliably avoided.

A structure of diffusion antenna 5 will be described in greater detail. Diffusion antenna 5 has surfaces perpendicular to and along the propagation direction of the microwaves on the side opposite to magnetron antenna 11 of rotating plate 9. Namely, diffusion antenna 5 has an L-like shape on the side opposite to magnetron antenna 11 of rotating plate. Thus, diffusion antenna 5 has enhanced mechanical strength with respect to rotation of rotating plate 9 can be increased.

Figure 9:
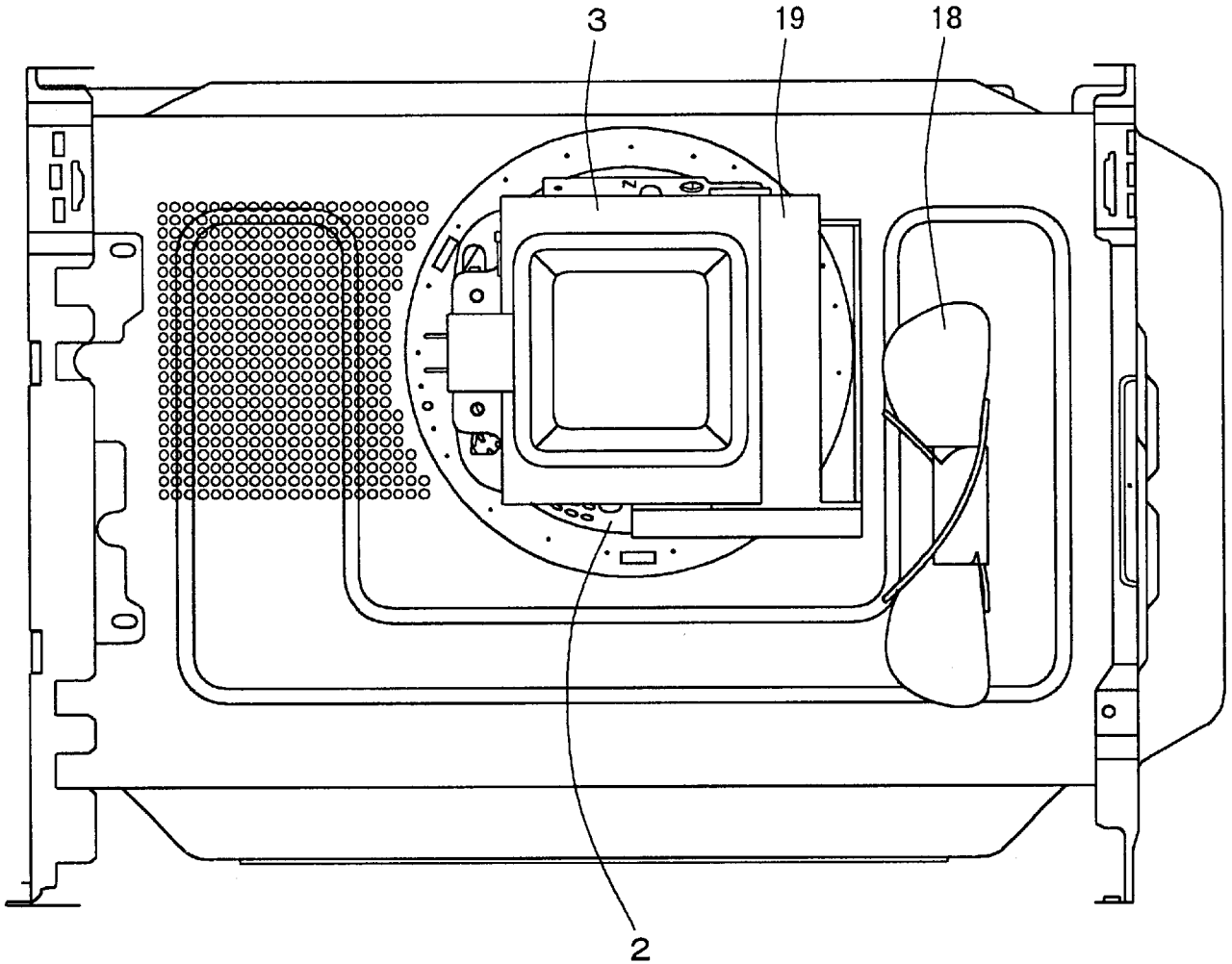
FIG. 9 is an illustration showing the right side of a frame portion of the microwave oven according to the third embodiment of the present invention.

Referring to FIG. 9, a rotating manner of rotating plate 9 and diffusion antenna 5 will be described in greater detail.

A cooling fan 18 for cooling magnetron 3 is mounted at the back of magnetron 3. Note that an air guide member 19 is attached to magnetron 3 at the portion opposite to cooling fan 18.

Figure 10:
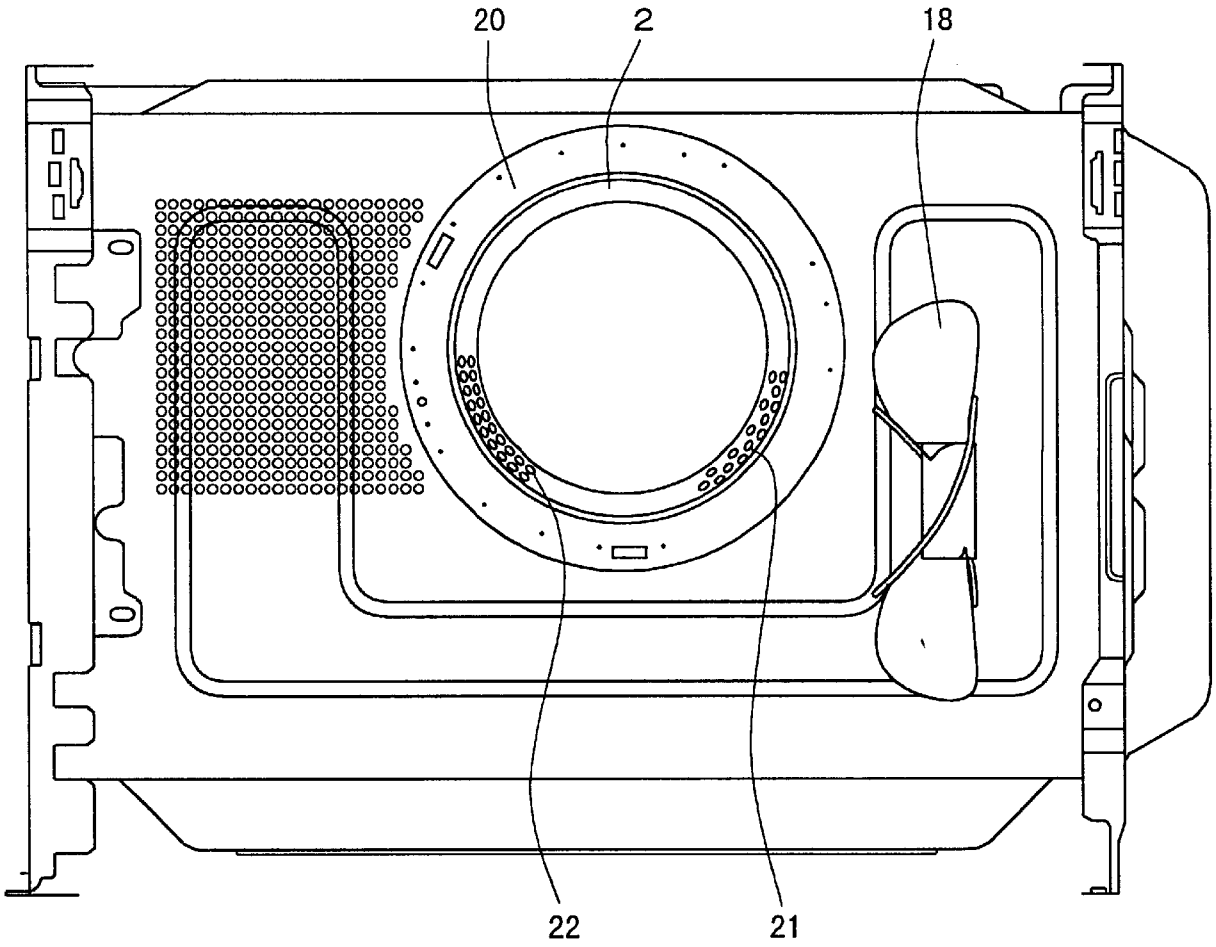
FIG. 10 is a side view of the microwave oven of FIG. 9, not showing the magnetron and the air guide member.

Air guide member 19 guides the air from cooling fan 18 toward magnetron 3 and inside waveguide 2. Note that waveguide 2 has an inlet hole and an outlet hole for the air generated by cooling fan 18. FIG. 10 shows a structure of FIG. 9 excluding magnetron 3 and air guide member 19. Referring to FIG. 10, the structure of waveguide 2 will be described.

Waveguide 2 has at its periphery a folded portion 20. Waveguide 2 is attached to an outer wall of heating chamber 1 for example by folded portion 20 screwed thereon. Waveguide 2 has two groups of holes in its side surface. A group of holes close to cooling fan 18 are inlet holes 21, and the other group of holes are outlet holes 22. Because of these holes, the air generated by cooling fan 18 is guided to waveguide 2 through inlet holes 21 to diffusion antenna 5 and then guided out of waveguide 2 through outlet holes 22 after causing rotation of rotating plate 9 provided with diffusion antenna 5. Namely, in the present embodiment, an antenna rotating portion is formed by cooling fan 18 which rotates diffusion antenna 5 by rotating rotating plate 9.

Returning to FIG. 9, air guide member 19 guides the air generated by cooling fan 18 to magnetron 3 and inlet holes 21 of waveguide 2. Note that the portion of air guide member 19 that is opposite to inlet holes 21 is formed to prevent introduction of foreign matters.

Figure 11:
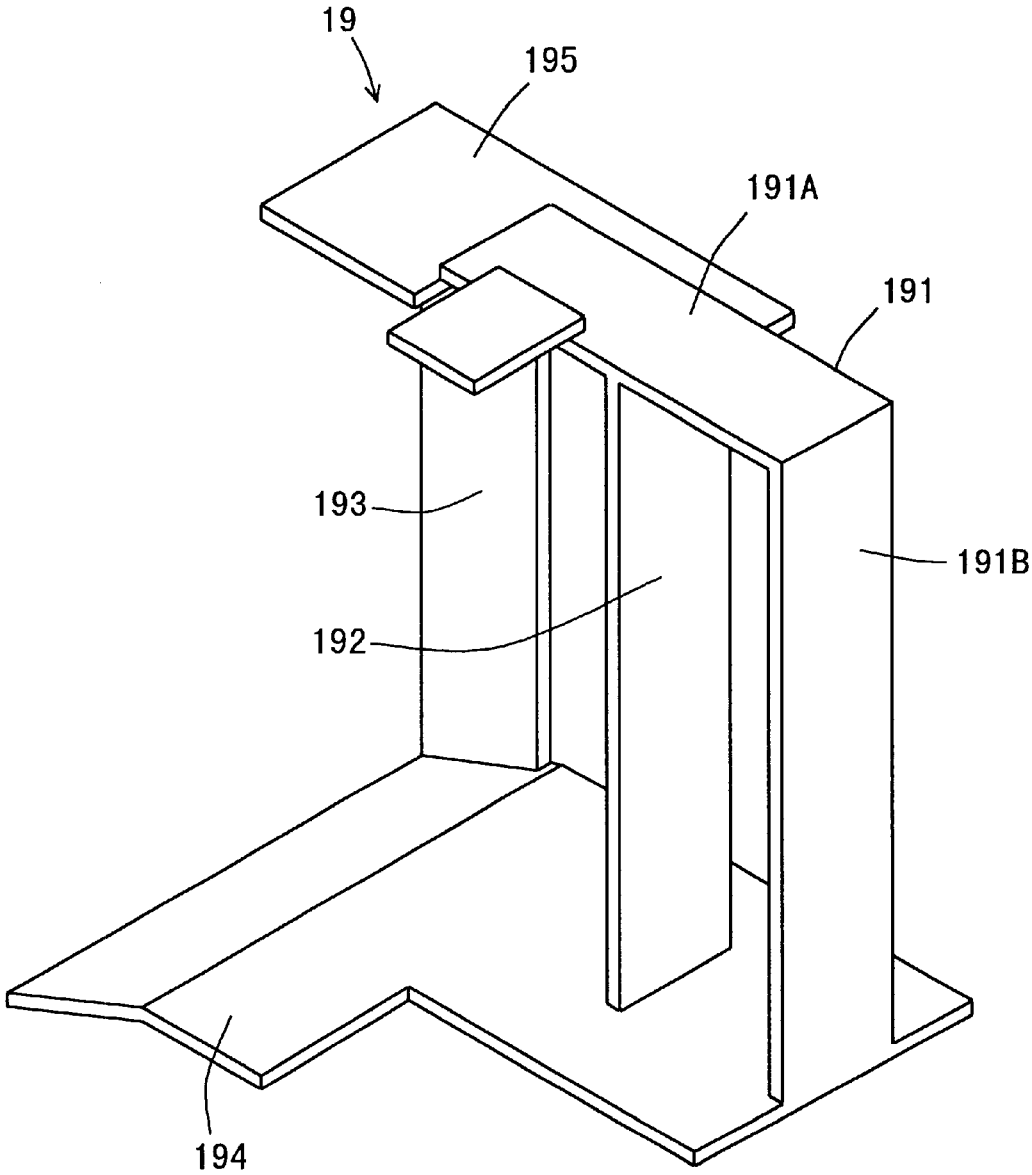
FIG. 11 is a perspective view showing the air guide member of FIG. 9.

Referring to FIG. 11, air guide member 19 has a frame 191, a partition 192, a shield 193, a lower plate 194, and an upper plate 195. Frame 191 has a horizontal surface 191A at the upper portion, and a vertical surface 191B having its upper end connected to horizontal surface 191A, and is connected to magnetron 3 and the portion of waveguide 2 without holes. The portion of waveguide 2 without holes refers to the portion closer to magnetron 3 than the portion of waveguide 2 with inlet holes 21.

Partition 191 is formed to correspond to the connecting portion of magnetron 3 and waveguide 2. Partition 191 forms a surface along a direction of guiding the air from cooling fan 18 and conveniently directs the air from cooling fan 18 to magnetron 3 and waveguide 2.

Shield 193 is arranged at the position about 1 cm apart from the surface where inlet holes 21 of waveguide 2 are formed to be opposite inlet holes 21. The provision of shield 193 prevents any bar-like object, such as a wire, from being inserted to waveguide 2 through inlet hole 21 even if such an object is inserted to the microwave oven of the present embodiment. In the present embodiment, shield 193 defines a wall surface arranged to have a prescribed gap with respect to the waveguide and placed opposite the hole of the waveguide in the air guide member.

Lower plate 194 defines a bottom surface of air guide member 19, whereas upper plate 195 forms a ceiling of air guide member 19 that is connected to waveguide 2. This allows the air from cooling fan 18 to be efficiently directed to magnetron 3 and waveguide 2.

Figure 12:
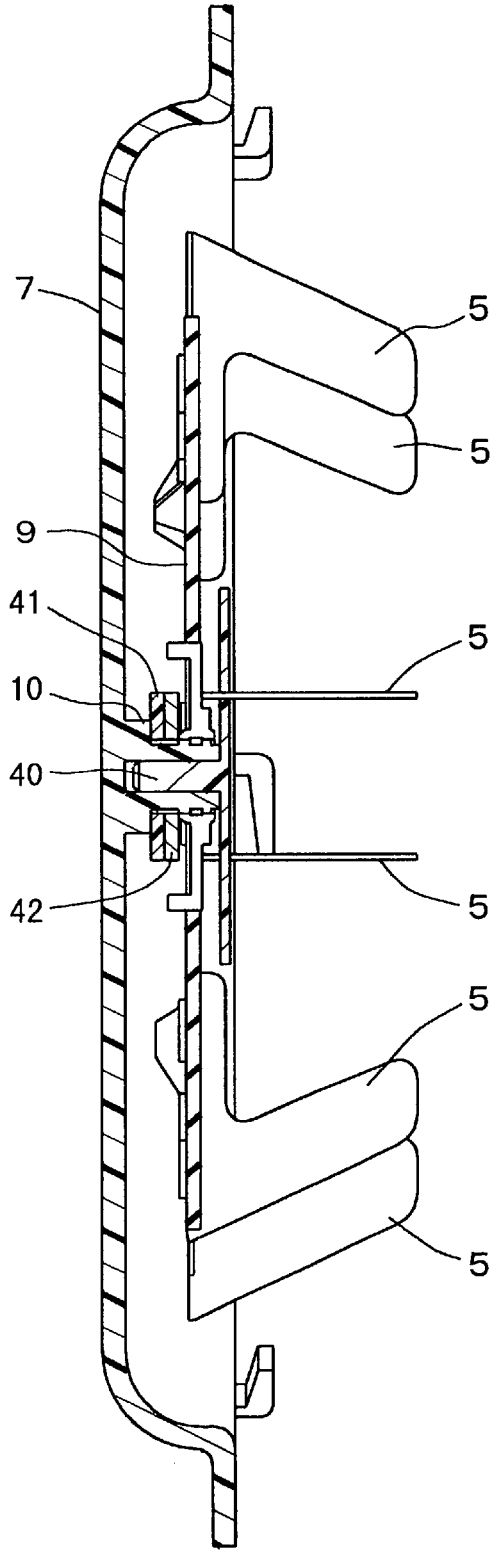
FIG. 12 is a cross sectional view showing a protection cover, a rotating plate and diffusion antennas of FIG. 5.

Next, referring to FIG. 12, a manner of mounting rotating plate 9 to protection cover 7 will be described.

As stated previously, rotating plate 9 is mounted to protection cover 7 by fitting rotating shaft 10 into hole 15 formed at the center of rotating plate 9. In the present embodiment, rotating shaft 10 has a cylindrical hole formed in a perpendicular direction. After rotating plate 9 is fitted onto rotating shaft 10 in hole 15, a mounting pin 40 is inserted to the hole formed in rotating shaft 10. Mounting pin 40 has a shaft portion inserted to the hole of rotating shaft 10, and a plate portion having a disk-like shape which is perpendicular to the shaft portion. Because mounting pin 40 is mounted onto rotating plate 9, rotation of rotating plate 9 is stabilized. As a result, rotation of diffusion antenna 5 is stabilized, whereby power is stably supplied to heating chamber 1. Here, the plate portion of mounting pin 40, i.e., a radius of the disk-like shape, is preferably as large as possible. In this case, the plate portion of mounting pin 40 is preferably formed to extend to a position closest to the central portion of rotating plate 9. This is because the greater the plate portion of mounting pin 40, the more the rotation of rotating plate 9 can be stabilized. Rotating plate 9 is mounted to protection cover 7 through a resin 41 and a metal washer 42. It is noted that metal washer 42 serves to provide for smooth propagation of radio waves between metal plates 5 which are oppositely arranged on rotating plate 9. The function of metal washer 42 will be described with reference to FIG. 13. Note that, in FIG. 13, to clarify the positional relationship among protection cover 7, metal washer 42, and rotating plate 9, the other components are omitted.

Figure 13:
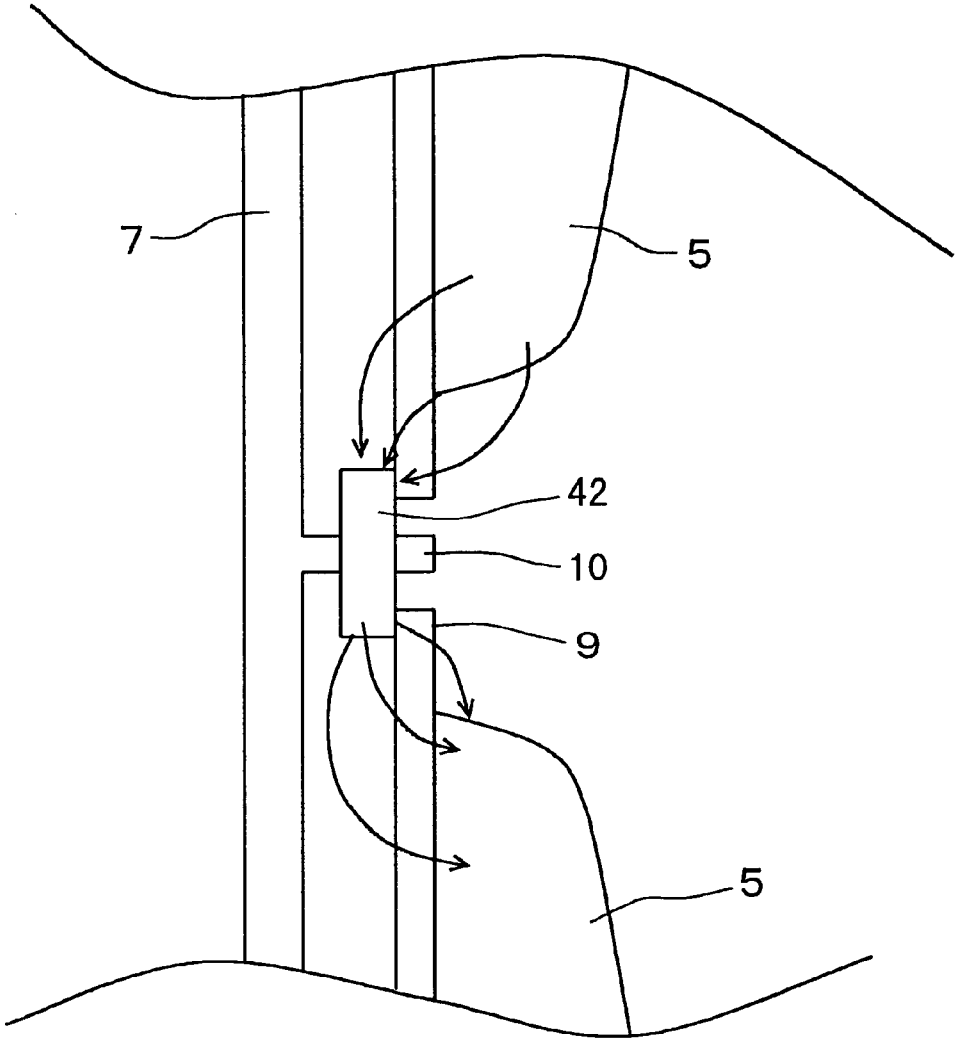
FIG. 13 is a side view showing a portion near a rotating shaft of the protection cover of FIG. 12.

Referring to FIG. 13, when magnetron 3 generates microwaves, metal washer 42, a conductor, provides for smooth propagation of radio waves between diffusion antennas 5 which are oppositely arranged, as indicated by an arrow in the drawing. This prevents electric field from concentrating at rotating shaft 10 positioned between diffusion antennas 5. Thus, cooking can be securely performed in the microwave oven.

Fourth Embodiment

Figure 14:
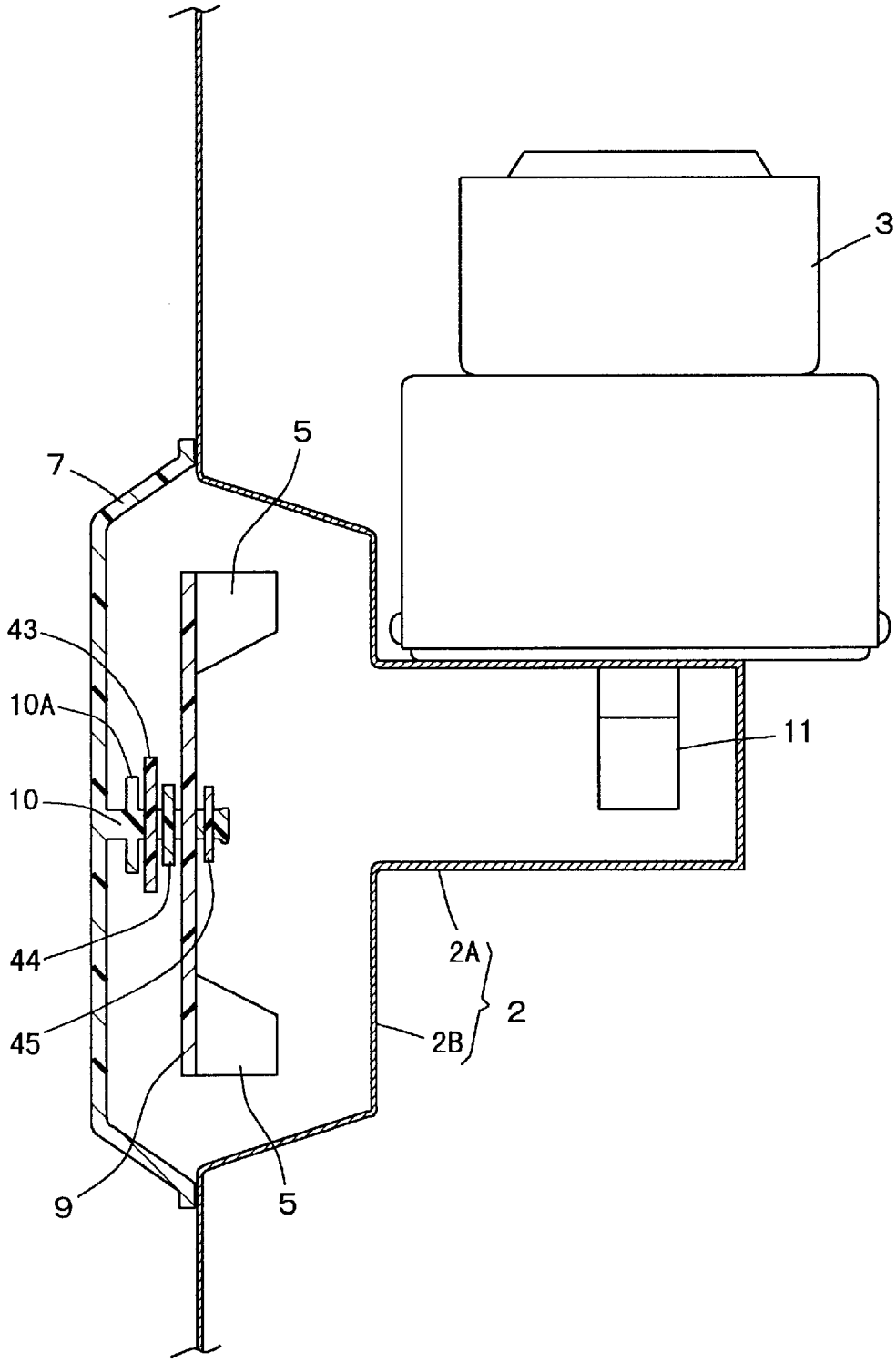
FIG. 14 is a cross sectional view showing a waveguide portion of a microwave oven according to a fourth embodiment of the present invention.

The microwave oven according to the fourth embodiment of the present invention will be described with reference to FIGS. 14, 15A, 15B, 16A and 16B. In FIG. 14, the same components as those of the microwave oven of the first embodiment are denoted by the same reference numerals, and therefore detailed description thereof will not be repeated.

A waveguide 2 of the present embodiment has a rectangular pole-like portion 2A and a cylindrical portion 2B. The cross sectional area of box portion 2A does not change in the propagation direction (a direction from the right to the left of FIG. 14) of the microwaves in waveguide 2. The cross section area of cylindrical portion 2B increases as closer to the heating chamber, i.e., toward the left side of FIG. 14, in the propagation direction of the microwaves in waveguide 2.

In the present embodiment, magnetron 3 is provided at the top of waveguide 2. Thus, a magnetron antenna 11 is downwardly mounted. In the present specification, as shown in FIG. 1, if magnetron 3 is attached to the side of waveguide 2, it is called that the magnetron is provided "horizontally." If, magnetron 3 is mounted at the top of waveguide 2 as shown in FIG. 14 or under waveguide 2, it is called that the magnetron is provided "vertically."

A protection cover 7 is mounted in the heating chamber to cover waveguide 2. A rotating plate 9 is rotatably mounted to a rotating shaft 10 of protection cover 7. A plurality of diffusion antennas 5 are attached to rotating plate 9.

Washer-like resins 44, 45 are fitted onto rotating shaft 10 to sandwich rotating plate 9. Washer-like resins 44, 45 enable smooth operation of rotating plate 9, especially at the start of rotation.

A metal washer 43 is fitted onto rotating shaft 10 on the side closer to the heating chamber than resin 44. Metal washer 43 serves a similar function as that of metal washer 42 described in the third embodiment. Namely, metal washer 43 serves to provide smooth propagation of radio waves between diffusion antennas 5 which are oppositely arranged through rotating shaft 10 on rotating plate 9. Note that rotating shaft 10 has a protrusion 10A on the side of waveguide 2. Metal washer 43 is interposed between resin 44 and protrusion 10A.

Figure 15B:
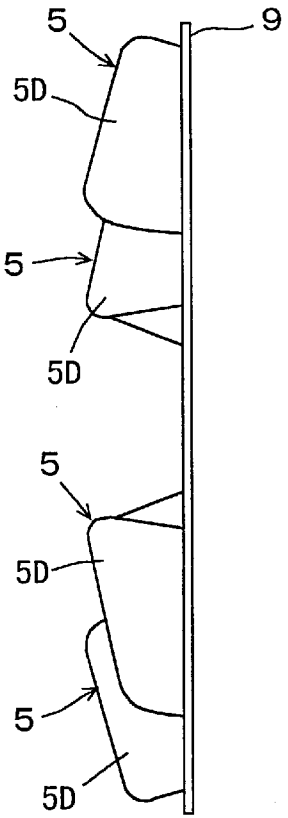
FIGS. 15A and 15B are respectively a plan view and a side view showing a rotating plate and diffusion antennas of FIG. 14.
Figure 15A:
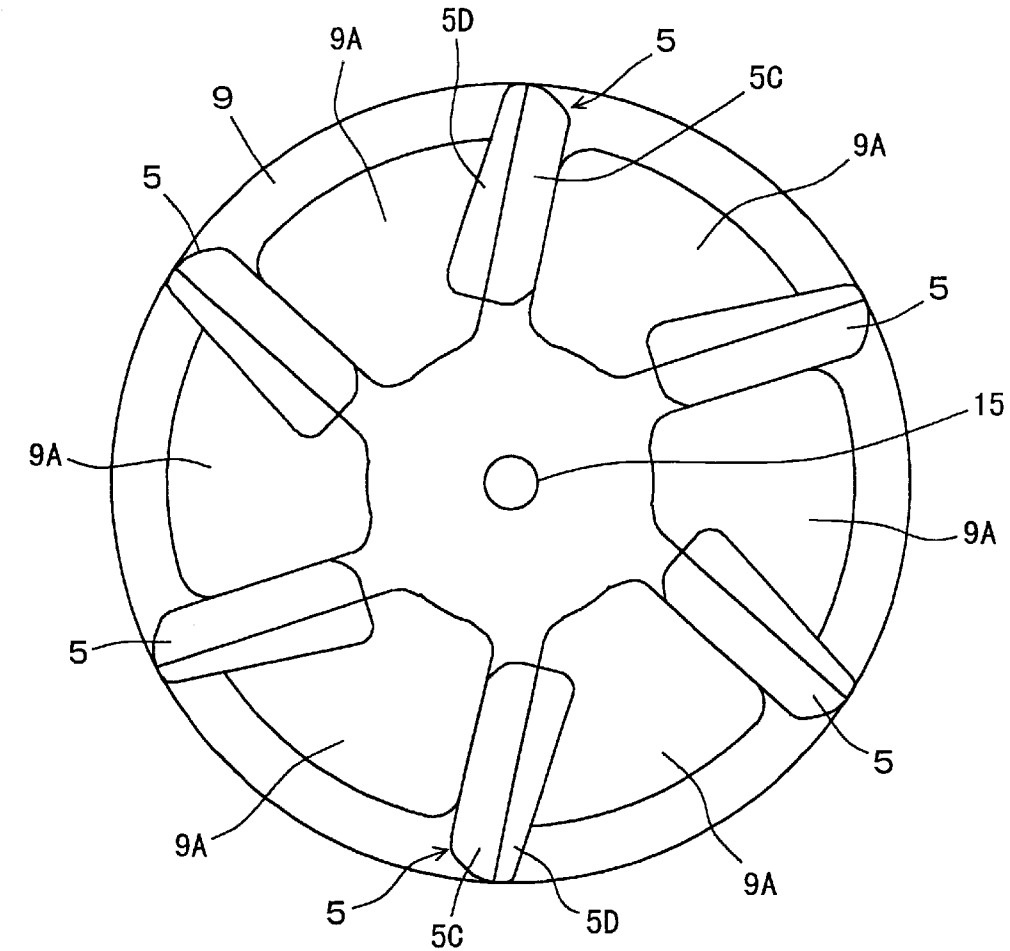

Now, referring to FIGS. 15A and 15B, rotating plate 9 of the present embodiment is formed of a dielectric material such as a mica plate. Rotating plate 9 has a hole 15 at the center thereof. Rotating plate 9 has a frame, and six holes 9A are formed inside the frame. Diffusion antennas 5 are respectively mounted on six stripe-like portions which are provided to separate six holes 9A in rotating plate 9. Like diffusion antenna 5 which has been described with reference to FIG. 7 or the like, diffusion antenna 5 of the present embodiment has a back portion, a bottom plate portion 5C, and a vertical portion 5D. When rotating plate 9 is mounted on protection cover 7, the plane of vertical portion 5D with a plate-like shape does not pass the center of magnetron antenna 11. Note that the back portion of diffusion antenna 5 of the present embodiment is not shown in FIGS. 15A and 15B.

As stated previously, in the microwave oven of the present embodiment, magnetron 3 is provided vertically. Here, with reference to FIGS. 16A and 16B, an effect produced by metal washer 43 in the microwave oven in which the magnetron is provided vertically will be described. Note that, in FIGS. 16A and 16B, dotted lines indicate electric fields generated when magnetron 3 generates microwaves.

Figure 16A:
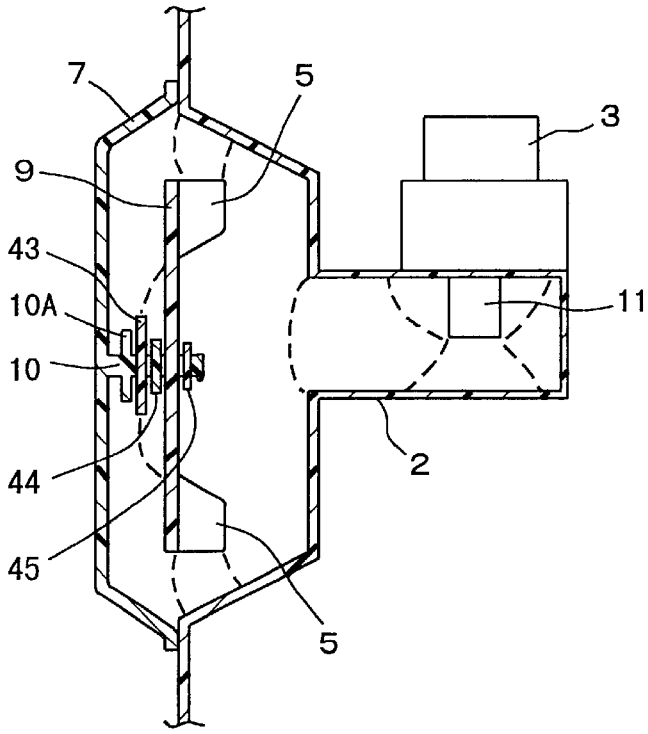
FIGS. 16A and 16B are diagrams shown in conjunction with an effect of a metal washer in the microwave oven of FIG. 14.

Referring to FIG. 16A, in the microwave oven in which the magnetron is provided vertically, as indicated by the dotted lines, electric fields are generated mainly between magnetron antenna 11 and waveguide 2 close to magnetron antenna 11, at the connecting portion of box portion 2A and cylindrical portion 2B of waveguide 2, between diffusion antenna 5 and waveguide 2 close to diffusion antenna 5, and in a space in which a plurality of diffusion antennas 5 are oppositely arranged through rotating shaft 10. In the microwave oven of the present embodiment, metal washer 43 is provided in the space in which a plurality of diffusion antennas 5 are oppositely arranged through rotating shaft 10.

Figure 16B:
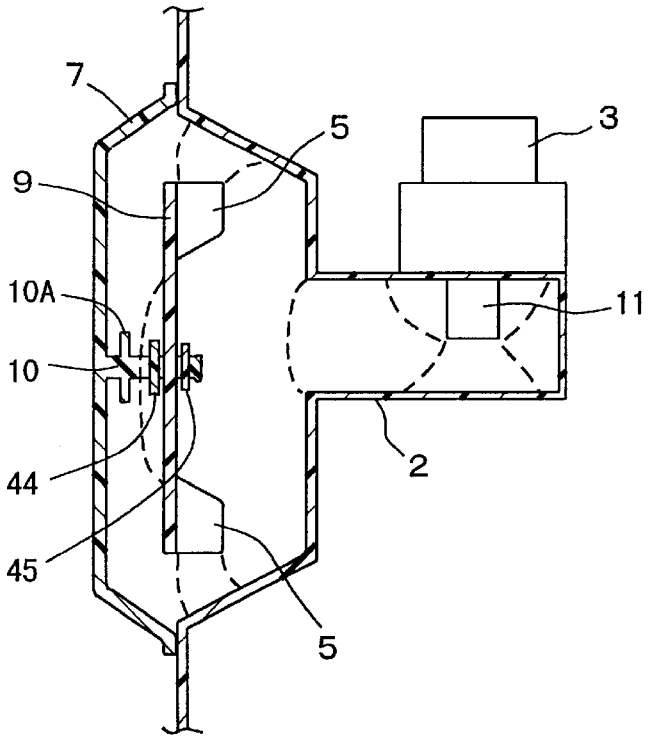

On the other hand, FIG. 16B shows the case where metal washer 43 is not provided, for the purpose of comparison. In the case shown in FIG. 16B, electric fields are generated at the same portion as in the case of FIG. 16A.

When comparing FIGS. 16A and 16B, in the microwave oven shown in FIG. 16A, the provision of metal washer 43 can prevent concentration of electric fields near rotating shaft 10. Accordingly, in the microwave oven of the present embodiment shown in FIG. 16A, even in the unusual event that an output from magnetron 3 is temporarily high, for example, melting or the like of rotating shaft 10 due to concentration of electric fields near rotating shaft 10 can be avoided.

In the microwave oven in which the magnetron is provided horizontally for example as shown in FIG. 1, electric fields are less likely to concentrate near rotating shaft 10 since electric fields are generated between magnetron antenna 11 and diffusion antenna 5. Accordingly, metal washer 43 described with reference to FIG. 14 or the like is particularly effective in the case of the microwave oven in which the magnetron is provided vertically.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A microwave oven comprising:

a heating chamber containing food;

a magnetron for heating the food in said heating chamber;

a waveguide connected to said heating chamber and said magnetron for guiding microwaves oscillated by said magnetron to said heating chamber;

a diffusion antenna diffusing the microwaves oscillated by said magnetron, said diffusion antenna extending from said waveguide to said heating chamber; and an antenna rotating portion rotating said diffusion antenna, wherein said antenna rotating portion rotates said diffusion antenna by air force, said waveguide has a hold for guiding the air from said antenna rotating portion to said waveguide, said microwave oven further includes an air guide member guiding the air from said antenna rotating portion to said waveguide, and said air guide member has a wall opposite the hole of said waveguide.

2. A microwave oven comprising:

a heating chamber containing food;

a magnetron for heating the food in said heating chamber;

a waveguide connected to said heating chamber and said magnetron for guiding microwaves oscillated by said magnetron to said heating chamber;

a diffusion antenna diffusing the microwaves oscillated by said magnetron, said diffusion antenna extending from said waveguide to said heating chamber; and an antenna supporting plate capable of supporting a plurality of said diffusion antennas, said antenna supporting plate having a notch between adjacent said diffusion antennas on said antenna supporting plate;

wherein said magnetron has a magnetron antenna for emitting microwaves, and said diffusion antennas are provided at prescribed intervals in a circumferential direction of said magnetron antenna.

3. The microwave oven according to claim 2, wherein said diffusion antenna has a plurality of surfaces, and at least one of the plurality of surfaces of said diffusion antenna is in a plane not passing a center of said magnetron antenna.

4. The microwave oven according to claim 3, wherein said diffusion antenna has an end parallel to an inner wall of said waveguide.

5. A microwave oven comprising:

a heating chamber containing food;

a magnetron for heating the food in said heating chamber;

a magnetron antenna for emitting microwaves;

an emission antenna provided around said magnetron antenna, said emission antenna being asymmetric with respect to said magnetron in a plane perpendicular to a propagation direction of the microwaves oscillated by said magnetron; and a diffusion antenna provided in said waveguide, wherein said emission antenna and said diffusion antenna are arranged to overlap with each other in the propagation direction of the microwaves oscillated by said magnetron.

6. The microwave oven according to claim 5, wherein at least one of said emission antenna and said diffusion antenna does not have a surface perpendicular to an inner wall of said waveguide.

* * * * *